United States Patent [19]

Zurawin et al.

[11] 4,164,803

[45] Aug. 21, 1979

[54] PAINT PAN FOR APPLYING PAINT TO PADS AND ROLLERS

[75] Inventors: Adam Zurawin, New York; Gaetano Ricciuti, Bronx, both of N.Y.

[73] Assignee: Adams Brush Manufacturing Co., Inc., Brooklyn, N.Y.

[21] Appl. No.: 843,212

[22] Filed: Oct. 18, 1977

[51] Int. Cl.[2] ..... B05C 1/02; B65D 1/36

[52] U.S. Cl. ..... 15/257.05; 15/257.06; 118/258

[58] Field of Search ..... 15/104.92, 257.05, 257.06; 101/331; 118/258; 222/403; 248/210, 211; 401/118

[56] References Cited

U.S. PATENT DOCUMENTS

| | | | |
|---|---|---|---|
| D. 205,443 | 8/1966 | Layman | D64/18 |
| D. 230,086 | 1/1974 | Meisner | D64/18 |
| 455,505 | 7/1891 | Brower | 118/258 |
| 653,695 | 7/1900 | Raff | 15/257.05 X |
| 2,419,959 | 5/1947 | Landau | 118/258 |
| 2,993,672 | 7/1961 | Bower et al. | 248/211 |
| 3,079,625 | 3/1963 | Rasmussen | 15/257.06 |
| 3,474,996 | 10/1969 | Stamm | 248/210 |
| 4,012,152 | 3/1977 | Lupkes | 401/218 |
| 4,106,434 | 8/1978 | Vines | 15/257.05 X |

FOREIGN PATENT DOCUMENTS

| | | | |
|---|---|---|---|
| 1427150 | 2/1976 | United Kingdom | 118/258 |

*Primary Examiner*—Daniel Blum

*Attorney, Agent, or Firm*—Hubbell, Cohen, Stiefel & Gross

[57] ABSTRACT

A convertible painting assembly includes a paint roller pan, the pan having a removable partition wall extending transversely between sump and trough portions therein. A removable paint transfer roller is rotatably mounted between the partition wall and the rear wall of the tray. Paint is transferred from the sump of the tray onto a paint pad which is supported by a novel pad suppport and handle assembly. With the transfer roller in place, the assembly can be used to apply paint to a painting pad. With the transfer roller and partition wall removed, the assembly can be used as a conventional roller pan.

3 Claims, 6 Drawing Figures

PAINT PAN FOR APPLYING PAINT TO PADS AND ROLLERS

BACKGROUND OF THE INVENTION

1. Field of the Invention

This invention relates generally to paint pans, and more particularly to paint roller pans which are convertible to pans for applying paint to painting pads.

2. The Prior Art

U.S. Pat. No. 3,079,625, issued Mar. 5, 1963, to E. E. Rasmussen shows a paint applicator roller and a leveling roller each rotatably mounted within a frame, and lying transversely in a paint pan. However, the rollers disclosed in the patent are not of the type suitable for applying paint to the surface of a planar paint pad, such paint pads becoming popular only in recent years. Rather, the rollers are arranged to load paint onto a conventional fabric covered paint roller as shown in the patent. Further, the two rollers disclosed in Rasmussen will not operate as intended unless they are used in conjunction with a conventional fabric paint roller. This is because rotary motion is transferred to the leveling roller by way of the fabric roller which, in turn, is rotated in response to movement of a hand crank connected to the applicator roller.

U.S. Pat. No. 3,648,322 shows a paint trough wherein a transfer roller is arranged to rotate and apply paint to a pad type of paint applicator. The paint pan shown in the patent is not of the type which may be used with the well-known fabric covered paint rollers. Also, a separate overlying tray, having an opening therein through which the transfer roller is to protrude, is placed over the trough to facilitate the transfer of paint onto the paint pad.

SUMMARY OF THE INVENTION

The present invention provides a significant improvement in paint pans as depicted in the above-cited prior art patents. In particular, one aspect of the present invention provides a paint roller pan having a removable partition wall which furnishes a removable mounting for a cylindrical paint transfer roller. Thus, the paint roller pan may be easily converted to a paint pad pan.

BRIEF DESCRIPTION OF THE DRAWINGS

The above and other features of the present invention will be better understood by those skilled in the art with reference to the following detailed description and the accompanying drawings in which.

DETAILED DESCRIPTION OF THE INVENTION

Figure 1:
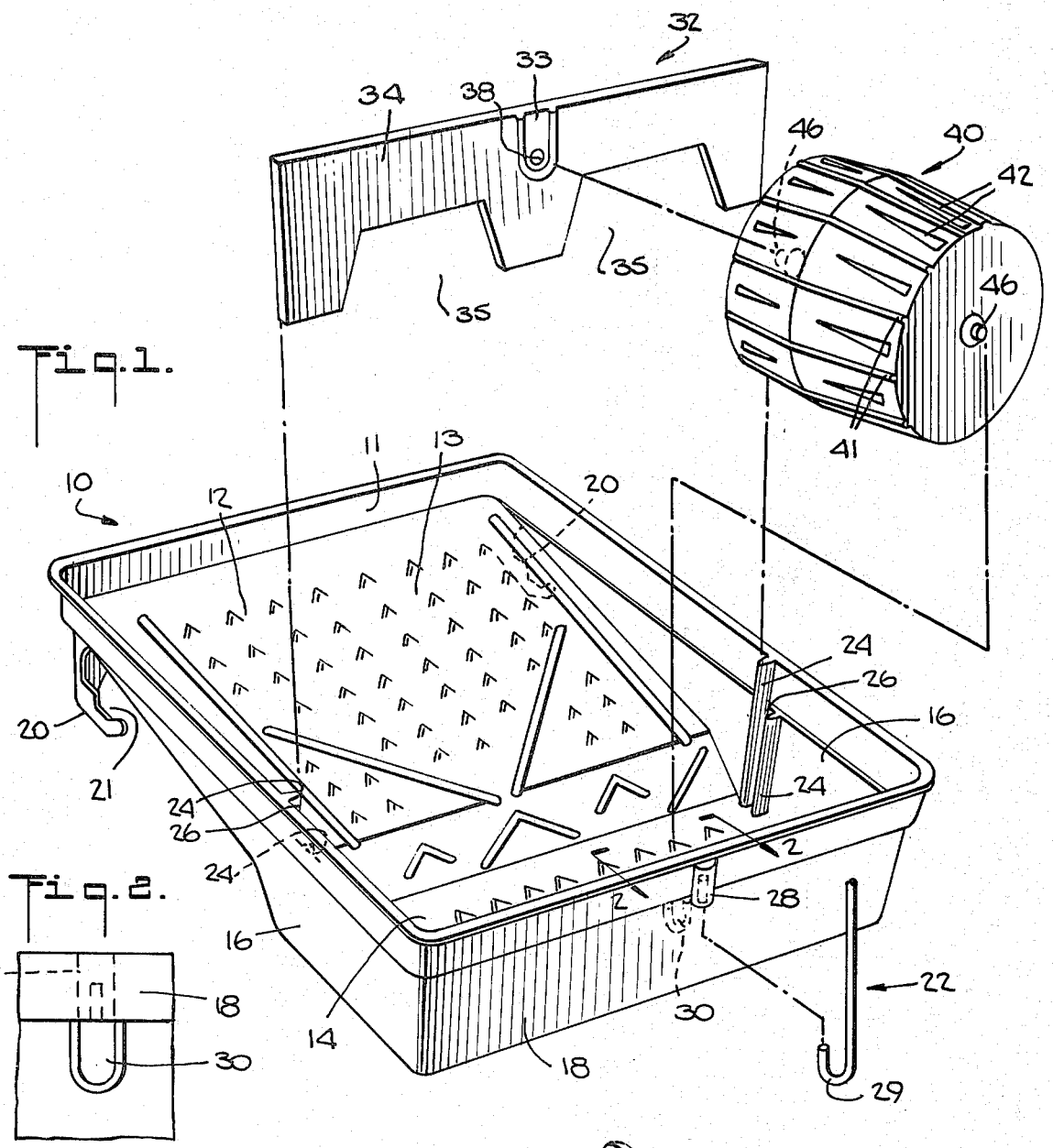
FIG. 1 is an exploded perspective view of a convertible paint roller and paint pad pan embodying this invention.

Referring now to the drawings in detail and especially to FIG. 1 thereof, a convertible roller pan/paint pad applicator is designated generally by the reference numeral 10. The pan 10 is provided with a peripherally continuous wall including a front wall 11, a rear or back wall 18, both of which are joined by spaced apart parallel side walls 16. The bottom of the convertible pan 10 is defined by a bottom wall 12 which extends between side walls 16 and has a front downwardly sloping trough portion 13 on which a conventional fabric roller may be rolled to distribute paint, and a flat rear portion 14 forming a paint sump.

Figure 2:
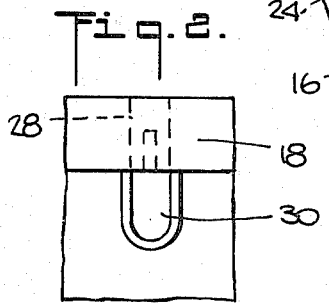
FIG. 2 is a view taken along lines 2—2 of FIG. 1.

Vertically disposed on the interior of each of side walls 16, at a location between the trough and sump portions of the pan 10, are means for removably mounting a partition wall 32. The mounting means comprise guide means 24 defining slots 26 on each of the side walls 16, in which the partition wall 32 may be slidably removably inserted. The pan 10 also includes a U-shaped protrusion, as shown more clearly in FIG. 2, extending inwardly from the center of the rear wall 18, a slot 30 defined by the U-shaped protrusion being of such dimension to accept either one of two axle stubs 46 which extend from the sides of a transfer roller 40, respectively, as shown in FIG. 1. A similar U-shaped protrusion is provided on the center of partition wall 32 to define a slot 33 for receiving an axle stub 46 protruding from the other end wall of transfer roller 40.

Still referring to FIG. 1, a portion of the bottom of the partition wall 32 when mounted on side walls 16 is spaced from bottom wall 13 as by a pair of cutouts 35 extending upwardly from the bottom thereof. These cutouts 35 are provided to permit paint loaded into the trough of the pan 10 to flow past the wall 32 into the sump portion of the pan 10 to be deposited on the transfer roller 40 inserted as in FIG. 3 for application to a paint pad. Preferably, a circular opening 38 extends through the partition wall 32 at the bottom of the slot 33. The opening 38 is of such diameter to accommodate for smooth rotation one of the aforementioned transfer roller axle stubs 46. It will, of course, be appreciated that when the partition wall 32 is inserted in the slots 26 defined on the side walls 16 of the pan 10, the U-shaped slot 33 in partition wall 32 becomes aligned with the bottom of the slot 30 defined on the interior of the rear wall 18 of the pan 10. This alignment permits the transfer roller 40 to rotate about an axis substantially parallel to the flat rear portion 14 of bottom 13 and perpendicular to the rear wall 18.

Figure 3:
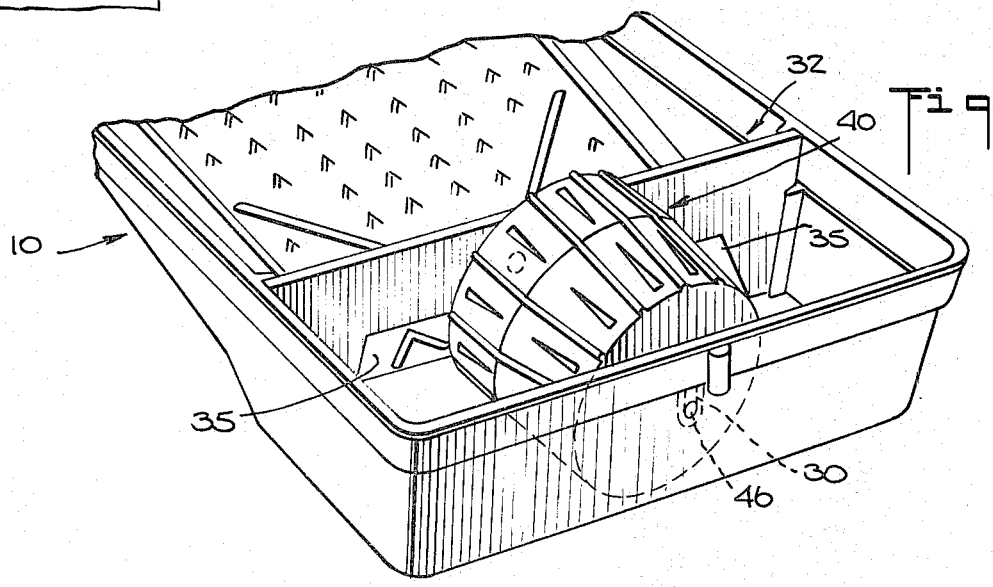
FIG. 3 is a fragmentary perspective view of the pan assembly of FIG. 1, but ready for use with a paint pad.

With the partition wall 32 inserted in the pan 10 as shown in FIG. 3, the transfer roller 40 may be easily inserted for rotatable movement within the sump portion of the pan 10 by disposing aligned axle stubs 46 in U-shaped slots 30 and 33. One of the stubs 46 will also extend through the opening 38 in the partition wall 32.

The transfer roller 40 is cylindrically shaped and preferably has longitudinal ribs 41 and inwardly projecting fingers 42 formed alternately along its outer surface. The ribs 41 and fingers 42 act to provide frictional engagement of the transfer roller 40 with a paint pad when the pad is moved across the top of the transfer roller 40 for loading paint thereon.

When the partition wall 32 and the transfer roller 40 are mounted in the pan 10, paint may be loaded into the pan 10 by pouring it from a container into the trough portion of the pan whereby it will flow downwardly and through the cutouts 35 provided in the partition wall until it reaches a level in the sump portion of the pan to contact the lower surface of the transfer roller 40. When the roller is caused to rotate as by, for example, the movement of a paint pad tangentially across the top thereof, it will be apparent that paint will be picked up out of the sump by the roller and deposited onto the surface of the pad. With partition wall 32 and roller 40 removed, pan 10 may be employed as a conventional roller pan.

Pan 10 also preferably includes a pair of leg members 20 extending downwardly from the bottom wall 12 in the vicinity of the front of the pan 10, each of the legs being L-shaped to define an opening 21 facing towards the rear of the pan. These openings 21 in the leg members 20 are dimensioned to receive a conventional extension ladder rung, and to allow the forward portion of the pan to rest atop the rung 49 as shown in FIG. 4.

Figure 4:
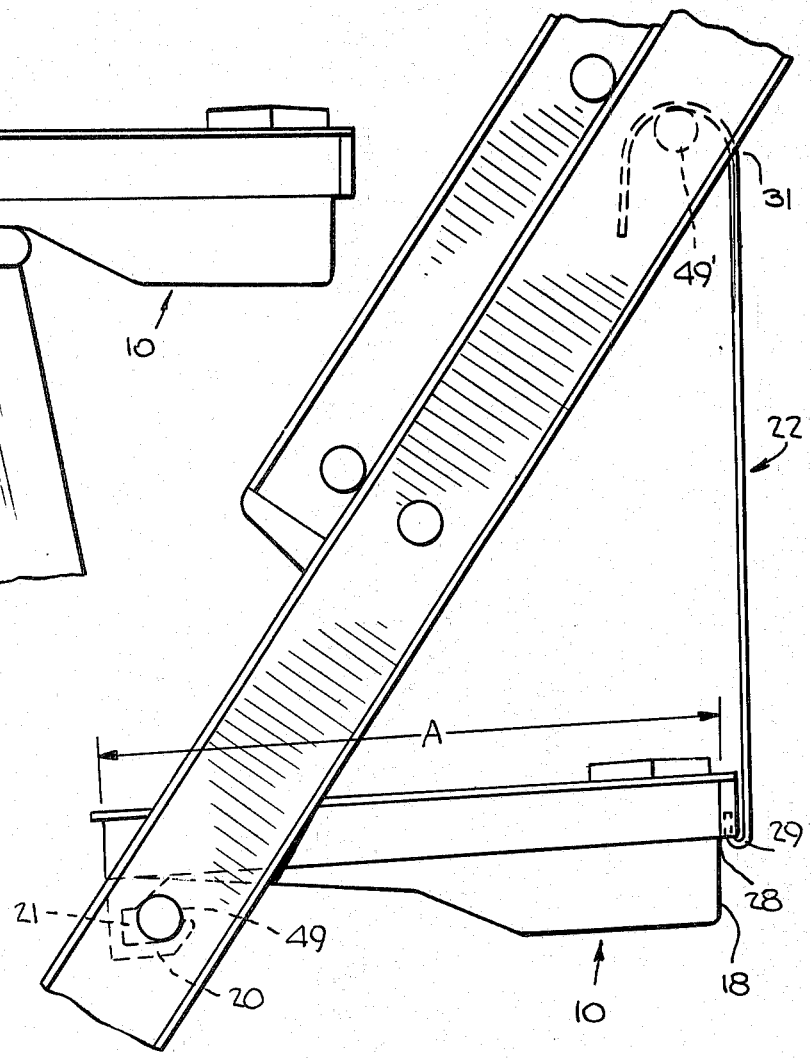
FIG. 4 is a fragmentary view partly in section and partly in elevation, of the pan assembly mounted to rungs of a conventional extension ladder.

Although ladder rung 49 is shown in FIG. 4 as being cylindrical, the openings 21 in leg members 20 are preferably dimensioned to accommodate all ladder rung cross-sections widely used as, for example, "V"-shaped, triangular shaped, and trapezoidal shaped as well as the round shaped cross-section shown in FIG. 4.

Further, a hollow cylindrical boss 28 is provided on the outside of the rear wall 18 of the pan. Boss 28 is proportioned to slidably receive the lower hooked end 29 of an elongated hook 22. The upper end 31 of the hook 22 is also formed to engage an extension ladder rung 49' so that, when legs 20 of the pan 10 slide over the ladder rung 49 and the hook 22 engages both the rear wall 18 of the pan 10 and the other ladder rung 49' positioned higher above the first rung 49, the pan will be securely supported between the two rungs 49, 49' of the extension ladder, thereby permitting use of the pan assembly when painting surfaces high above ground. Of course, the overall length A of the pan 10 must be suitably chosen to facilitate such ladder mounting. In this regard, the length A should preferably be around 15.75 inches (40 centimeters).

In FIG. 4, the elongated hook 22 appears substantially vertically disposed between the rear wall 18 of the pan 10 and the upper ladder rung 49'. This is merely for convenience of illustration. In use, in order to comply with safety requirements in certain instances, the extension ladder itself must be positioned in a more vertical orientation than that shown in FIG. 4, for example, at a 14½ degree inclination. Thus, in use, the elongated hook 22 will be longer, as compared with pan length A, than is shown in FIG. 4, in order to maintain the pan 10 horizontal.

To best accommodate the various inclinations possible for the extension ladder on which the paint pan 10 is to be mounted, it is therefore desirable that the elongated hook 22 be bendable to permit deflection to various angles with respect to the rear wall 18 of pan 10, as well as to adjust its effective length to permit the pan 10 to rest substantially horizontal regardless of the angle of the ladder or the spacing of the rungs 49.

Figure 3A:
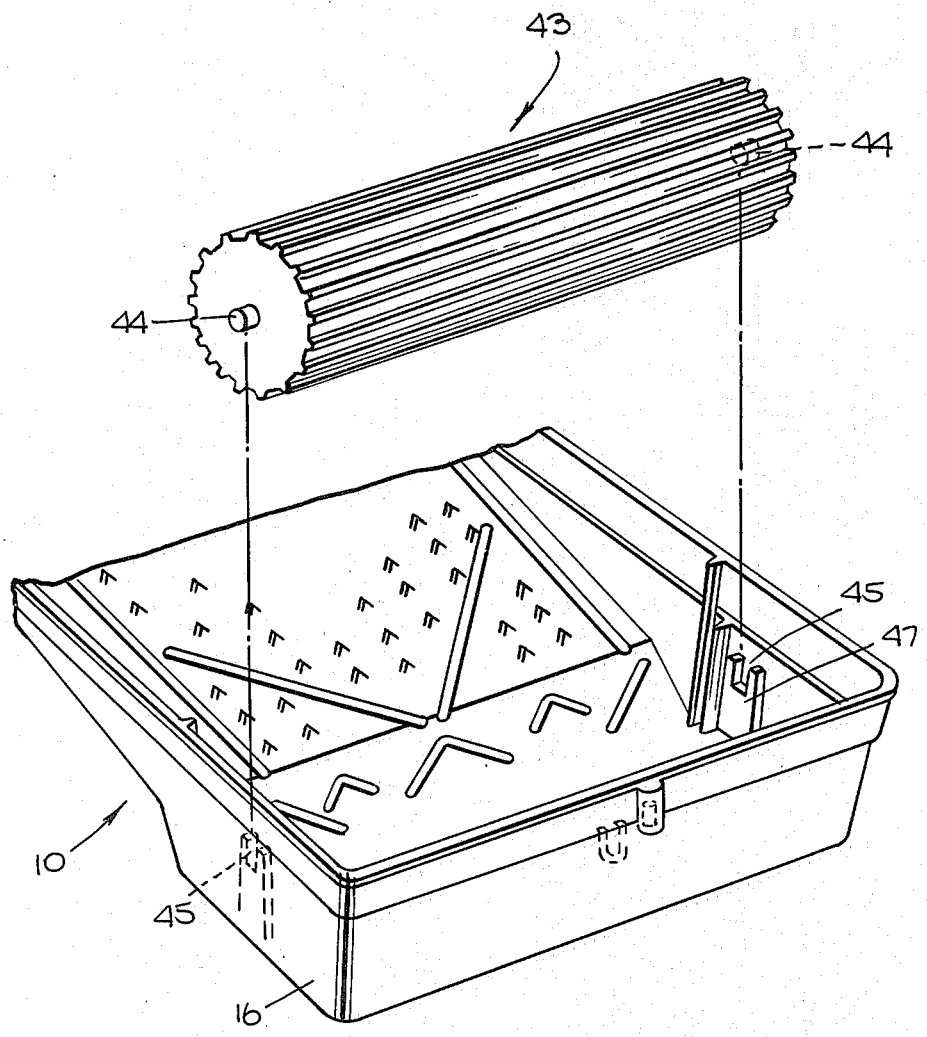
FIG. 3A is a fragmentary exploded perspective view of another embodiment of the pan assembly of FIG. 1.

An additional convenient feature may be incorporated in the pan 10 as shown in FIG. 3A. A ribbed paint transfer roller 43, being of a length nearly equal to the width across the rear sump portion of the pan 10, can be placed for rotation within the rear sump. Axially aligned stubs 44 are provided at opposite ends of the roller 43 for insertion into corresponding slotted openings 45 provided in support bearings 47. The support bearings 47 are preferably integrally formed on the inside surfaces of side walls 16 of the pan 10 in oppositely facing relationship to one another.

Using the configuration shown in FIG. 3A, it will be understood that the partition wall 32 shown in FIGS. 1 and 3 is preferably not inserted within the pan 10 as it might otherwise interfere with free movement of a paint pad across the top of the ribbed roller 43 when a user loads paint onto the pad. Of course, roller 43 may be employed as an alternative to roller 40 and both need not be included in the same pan assembly.

Figure 5:
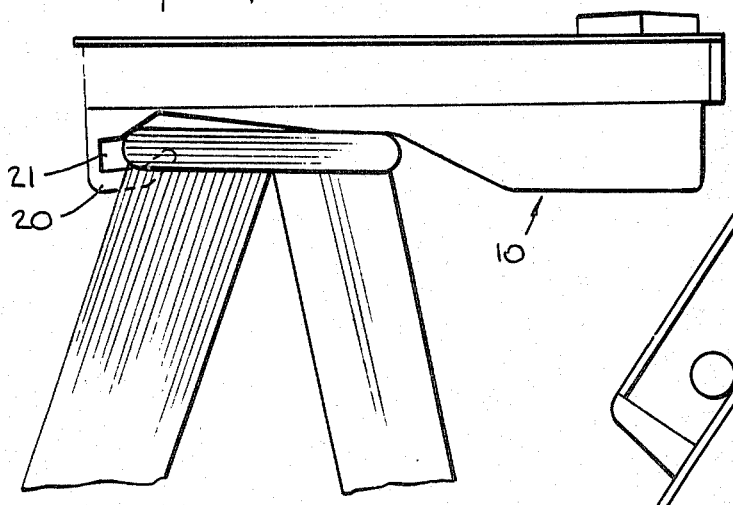
FIG. 5 is a side elevation view of the pan assembly mounted atop a conventional step ladder.

The pan assembly shown in FIGS. 1 to 3A may also be securely held across the top of a conventional step ladder. Such orientation is illustrated in FIG. 5. The L-shaped openings 21 in the legs 20 of the pan 10, being dimensioned to receive and bear against a conventional ladder rung, will also hook under the top portion of the step ladder to allow the pan to securely extend thereacross in a horizontal plane.

It will be appreciated that the convertible paint roller-paint pad pan is extremely useful and provides a high degree of flexibility in most painting situations. A painter thereby has at his or her disposal not only a conventional paint roller pan, but a complete assembly providing means for easily and effectively employing the newer painting pads.

Having thus fully described the present invention, what is claimed as new and desired to be secured by Letters Patent is:

1. In a paint roller pan of the type having a front wall, two side walls, a rear wall and a bottom wall having a front portion angled downwardly from said front wall to a zone intermediate said front and rear walls to define a trough on which a paint roller may be rolled to distribute paint thereon, and a rear horizontal portion defining the bottom of a paint sump, the improvement comprising means for converting said roller pan to a paint pad applicator, said means including:

a partition wall dimensioned to extend transversely of said tray between said side walls;

means disposed on the interior of each of said two side walls for removably mounting said partition wall on said side walls;

a cylindrical paint transfer roller; and means on the partition and rear wall for detachably mounting said roller between said partition wall and the interior of the rear wall of said tray, said roller being of diameter to dispose a portion thereof into said paint sump so that the roller is operative to transfer paint in said sump to a paint pad.

2. An assembly according to claim 1, wherein said partition wall has at least one opening at the bottom thereof to allow paint in said trough to flow into said sump when said partition wall is mounted in said pan.

3. An assembly according to claim 1, further comprising a member in the vicinity of the front of said pan extending downwardly beyond the bottom wall, said member having a rearwardly facing L-shaped opening thereon dimensioned to receive a ladder rung; an elongated hook member including means formed at one end thereof to engage another ladder rung; and means in the vicinity of the rear wall of said pan for detachably connecting the other end of said hook member to said pan so that the elongated member extends upwardly from said pan to engage said other ladder rung.

* * * * *